US010870044B2

(12) United States Patent
Richardson et al.

(10) Patent No.: US 10,870,044 B2
(45) Date of Patent: Dec. 22, 2020

(54) GOLF TEE TOSS SYSTEMS

(71) Applicants: Kevin Richardson, Brighton (CA); Brad Johnson, Trenton (CA)

(72) Inventors: Kevin Richardson, Brighton (CA); Brad Johnson, Trenton (CA)

( * ) Notice: Subject to any disclaimer, the term of this patent is extended or adjusted under 35 U.S.C. 154(b) by 0 days.

(21) Appl. No.: 16/032,018

(22) Filed: Jul. 10, 2018

(65) Prior Publication Data

US 2018/0318685 A1 Nov. 8, 2018

Related U.S. Application Data

(63) Continuation-in-part of application No. 15/145,636, filed on May 3, 2016, now abandoned.

(51) Int. Cl.

| | |
|---|---|
| ***A63B 57/00*** | (2015.01) |
| ***A63B 71/06*** | (2006.01) |
| ***A63B 67/06*** | (2006.01) |

(52) U.S. Cl.

CPC ..... *A63B 67/06* (2013.01); *A63B 57/00* (2013.01); *A63B 2071/0694* (2013.01)

(58) Field of Classification Search

CPC . A63B 67/06; A63B 57/00; A63B 2071/0694; A63B 57/30; A63B 57/35; A63B 57/353; A63B 57/50; A63B 65/08; A63B 65/10

USPC ..... 473/406, 408; D21/789, 794

See application file for complete search history.

(56) References Cited

U.S. PATENT DOCUMENTS

| | | | | | |
|---|---|---|---|---|---|
| 4,309,038 | A * | 1/1982 | Spoon | A63B 65/00 | 273/146 |
| 5,655,777 | A * | 8/1997 | Neading | A63B 65/08 | 473/594 |
| 6,017,282 | A * | 1/2000 | Stefonsky | A63B 57/353 | 473/406 |
| D437,020 | S * | 1/2001 | Streit | D21/794 | |
| 6,386,995 | B1 * | 5/2002 | Jastram | A63B 57/353 | 473/406 |
| D480,444 | S * | 10/2003 | Marchessault | D21/794 | |
| D488,528 | S * | 4/2004 | Kennedy | D21/793 | |
| D519,588 | S * | 4/2006 | Carbonero | D21/707 | |
| D818,552 | S * | 5/2018 | Cardinal | D21/794 | |
| 2004/0142773 | A1 * | 7/2004 | Kennedy | A63B 57/207 | 473/408 |
| 2010/0099518 | A1 * | 4/2010 | Osborn | A63B 69/3676 | 473/406 |
| 2013/0095958 | A1 * | 4/2013 | Solheim | A63B 57/50 | 473/406 |
| 2013/0260920 | A1 * | 10/2013 | Goldsmith | A63B 57/353 | 473/404 |
| 2015/0005117 | A1 * | 1/2015 | Martyn | A63B 67/066 | 473/595 |

(Continued)

*Primary Examiner* — Steven B Wong

(74) *Attorney, Agent, or Firm* — Argus Intellectual Enterprise; Daniel Enea; Jordan Sworen

(57) ABSTRACT

A golf tee toss system for deciding the order of play in a game of golf. The golf tee toss device is grasped by a protruding edge and tossed to the ground. The numerals located on the surface of the golf tee toss device indicate the order in which the golfers will tee off to start a round of golf. The golf tee toss device can be used over and over for different rounds of golf. The indicium on the golf tee toss device can be in a plurality of designs to promote collection of the golf tee toss device.

1 Claim, 5 Drawing Sheets

(56) References Cited

U.S. PATENT DOCUMENTS

| | | | | |
|---|---|---|---|---|
| 2015/0024862 | A1* | 1/2015 | Muller | A63B 69/3641 473/257 |
| 2017/0001085 | A1* | 1/2017 | Russell | A63B 71/0009 |

* cited by examiner

GOLF TEE TOSS SYSTEMS

CROSS-REFERENCE TO RELATED APPLICATION(S)

The present application is related to and is a continuation in part to U.S. Non-Provisional patent application Ser. No. 15/145,636 filed May 3, 2016, which is incorporated by reference herein in its entirety.

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

Technical Field

The present invention relates generally to the field of golf accessories and more specifically relates to a device for determining the order of play.

Description of Related Art

Golf is a club and ball sport in which players use various clubs to hit balls into a series of holes on a course in as few strokes as possible. Golf is one of the few ball games that do not require a standardized playing area. The game is played on a course with an arranged progression of either nine or 18 holes. Each hole on the course must contain a tee box to start from, and a putting green containing the actual cup. There are other standard forms of terrain in between, such as the fairway, rough, and hazards, but each hole on a course is unique in its specific layout and arrangement. Golf is played for the lowest number of strokes by an individual, known as stroke play, or the lowest score on the most individual holes in a complete round by an individual or team, known as match play. Stroke play is the most commonly seen format at all levels. A tee is typically used to determine in which order the players will tee off. A suitable solution is desired.

Several attempts have been made to solve the above-mentioned problems such as those found in U.S. Pub. No. 2006/0151950 to Paul Buckley; 2016/0071440 to Laura Ann Hibbert; 2009/0108524 to Alvin Baylis; 2010/0295248 to Roy Krause et al.; U.S. Pat. No. 1,579,341 to Jay K. Allen; U.S. Pat. No. 7,793,445 to Lonnie L. Lawrence; U.S. Pat. No. 2,836,911 to Charles Priesmeyer; U.S. Pat. No. 3,697,237 to Richard Seiz; U.S. Pat. No. 5,470,077 to Wilfred G. Brewster; and U.S. Pat. No. 8,648,710 to Daniel V. LaRue. This art is representative of golf accessories. However, none of the above inventions and patents, taken either singly or in combination, is seen to describe the invention as claimed.

Preferably, a golf tee toss system should provide a device for determining the order of play and yet would operate reliably and be manufactured at a modest expense. Thus, a need exists for a reliable golf tee toss system to avoid the above-mentioned problems.

BRIEF SUMMARY OF THE INVENTION

In view of the foregoing disadvantages inherent in the known golf accessories art, the present invention provides a novel golf tee toss system. The general purpose of the present invention, which will be described subsequently in greater detail is to provide a device for determining the order of play without using a handful of golf tees.

A golf tee toss system is disclosed herein, in a preferred embodiment, comprising: a golf tee toss device comprising a front surface comprising an outside circle, an inside circle, a first-small-circle, a second-small-circle, a third-small-circle, a fourth-small-circle, and a multiple-leveled numerated gripper indicium, a thickness, and a periphery comprising a top edge, a bottom edge, a left edge, a right edge, and a back-surface comprising a smooth finish and a second multiple-leveled numerated gripper indicium. The golf tee toss system comprises the golf tee toss device. The golf tee toss device is defined by the front surface, the thickness, the periphery, and the back-surface for determining an order of play in a golf game. The front surface comprises the outside circle, the inside circle, the first-small-circle, the second-small-circle, the third-small-circle, the fourth-small-circle, and the indicium used to select the order of play in a golf game. The thickness is defined by the front surface and the back-surface.

The periphery is defined by the top quadrant, the bottom quadrant, the left quadrant, and the right quadrant. The back-surface comprises the smooth finish for ease of rotating when tossed to ground to select the order of play in a golf game, and the golf tee toss system is tossed to ground before a round of golf to select the order of play in a golf game. The front surface comprises top of the golf tee toss device useful for selecting the order of play in a golf game. The outside circle defines relative placement of the first-small-circle, the second-small-circle, the third-small-circle, and the fourth-small-circle. The inside circle further defines placement of the first-small-circle, the second-small-circle, the third-small-circle, and the fourth-small-circle. The first-small-circle, second-small-circle, third-small-circle, and fourth-small-circle protrude beyond the edge useful for gripping and tossing the golf tee toss device. Relationally speaking, the first-small-circle opposes the second-small-circle, and the third-small-circle opposes the fourth-small-circle.

The indicium comprises numerals useful for selecting the order of play in the golf game. The thickness comprises exactly five millimeters in certain preferred embodiments and more than five millimeters or less than five millimeters in alternate embodiments. The golf tee toss device comprises a span of one hundred and twelve millimeters in preferred versions. The back-surface comprises second indicium useful for selecting the order of play in the golf game.

A golf tee toss system kit is also disclosed herein, including the golf tee toss device, and a set of user instructions.

A method of using a golf tee toss system is also disclosed herein comprising the steps of: grasping a golf tee toss device; throwing the golf tee toss device; reading indicium to determine order of play; and picking up the golf tee toss device from a ground surface. The method may further comprise the step of placing the golf tee toss device into a pocket/bag.

The present invention holds significant improvements and serves as a golf tee toss device. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, golf tee toss system, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to golf accessories and more particularly to a golf tee toss system as used to improve the way in which the order of play in a golf game is selected.

Generally speaking, a player tosses a tee a few times to determine the order in which players tee off. The tee toss is thrown one time which then will denote the order of the golf group. Every round of golf is based on playing a number of holes in a given order. A round typically consists of 18 holes that are played in the order determined by the course layout. Each hole is played once in the round on a standard course of 18 holes; on a nine-hole course, players may play a short game playing each hole once, or a full round by playing each hole twice. Not only are the holes played in a specific order, the order the golfers play in is also pertinent.

Figure 1:
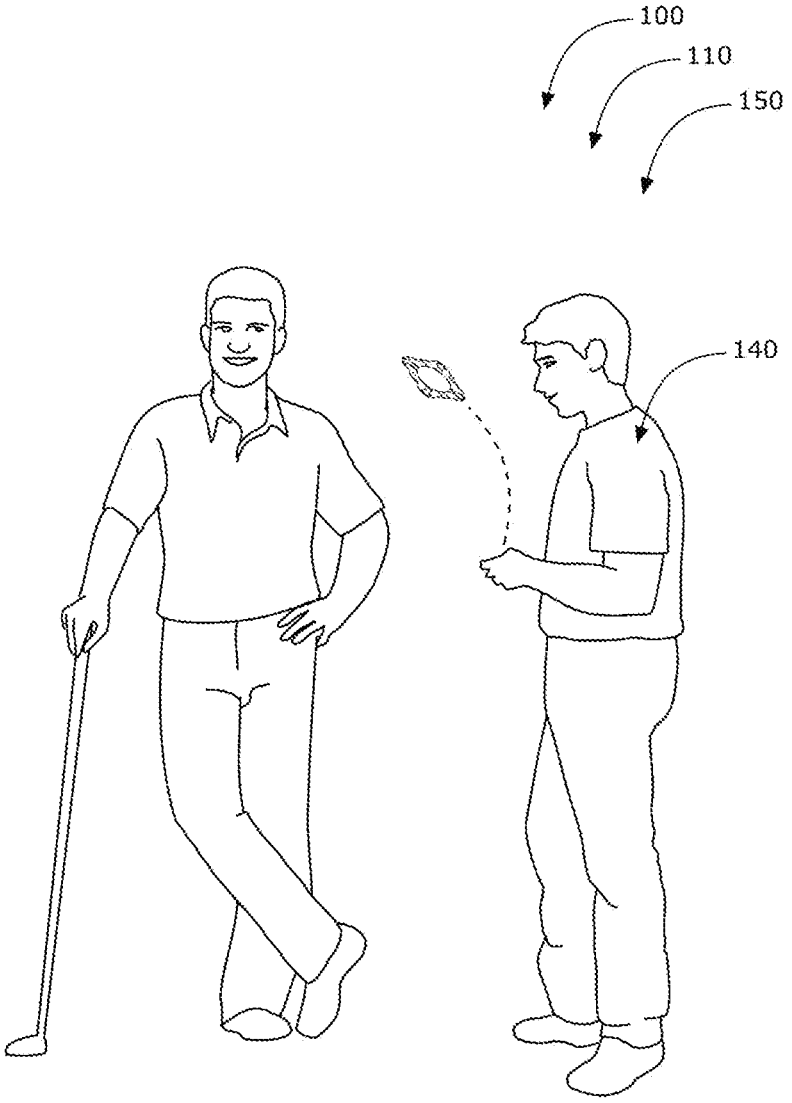
FIG. 1 shows a perspective view illustrating a golf tee toss system during an 'in-use' condition showing a pair of golfers tossing the golf tee toss device according to an embodiment of the present invention.
Figure 2:
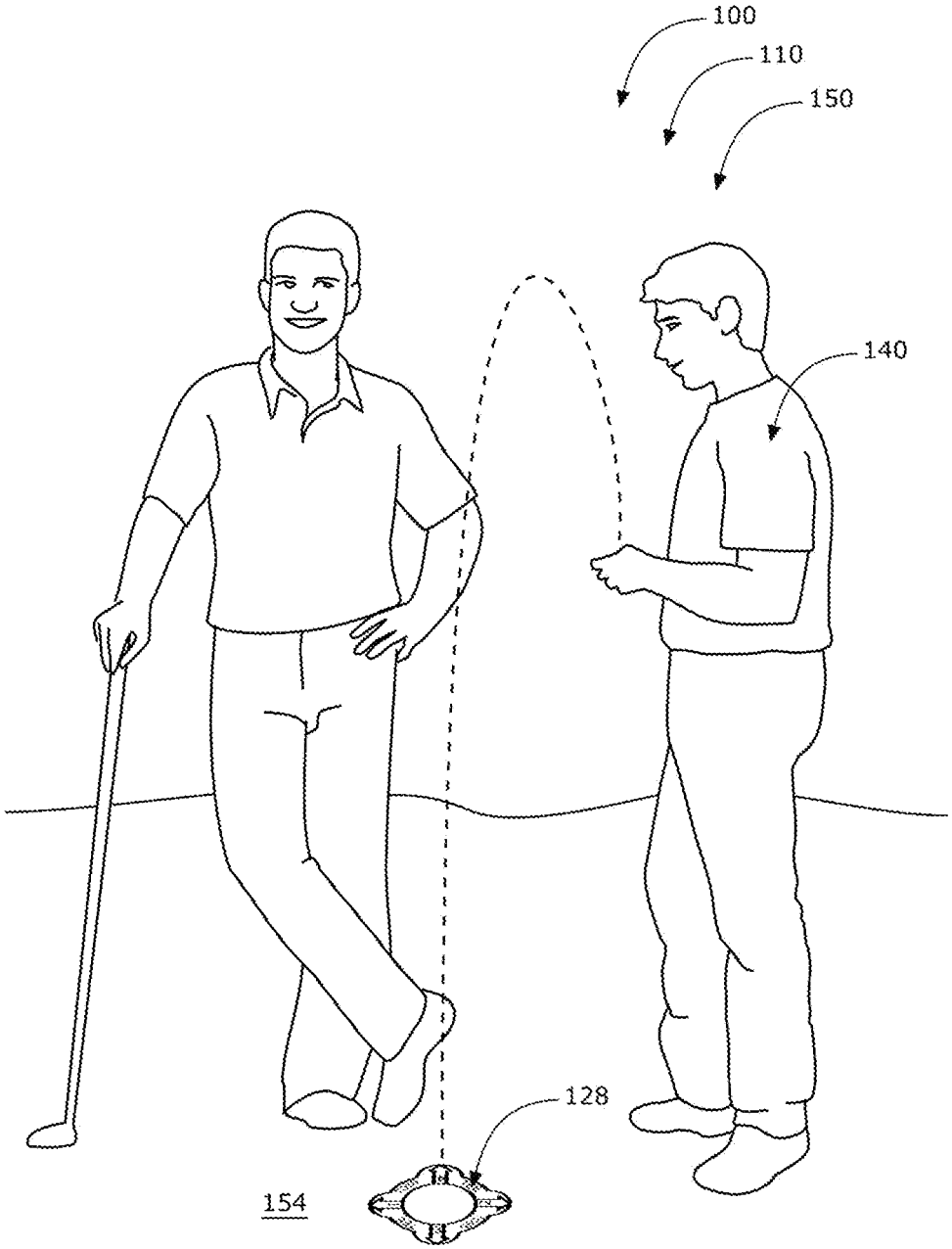
FIG. 2 is a perspective view illustrating the golf tee toss during an 'in-use' condition showing a pair of golfers tossing the golf tee toss device, and the golf tee toss device landing on the ground to indicate order of play in a game of golf according to an embodiment of the present invention of FIG. 1.
Figure 3:
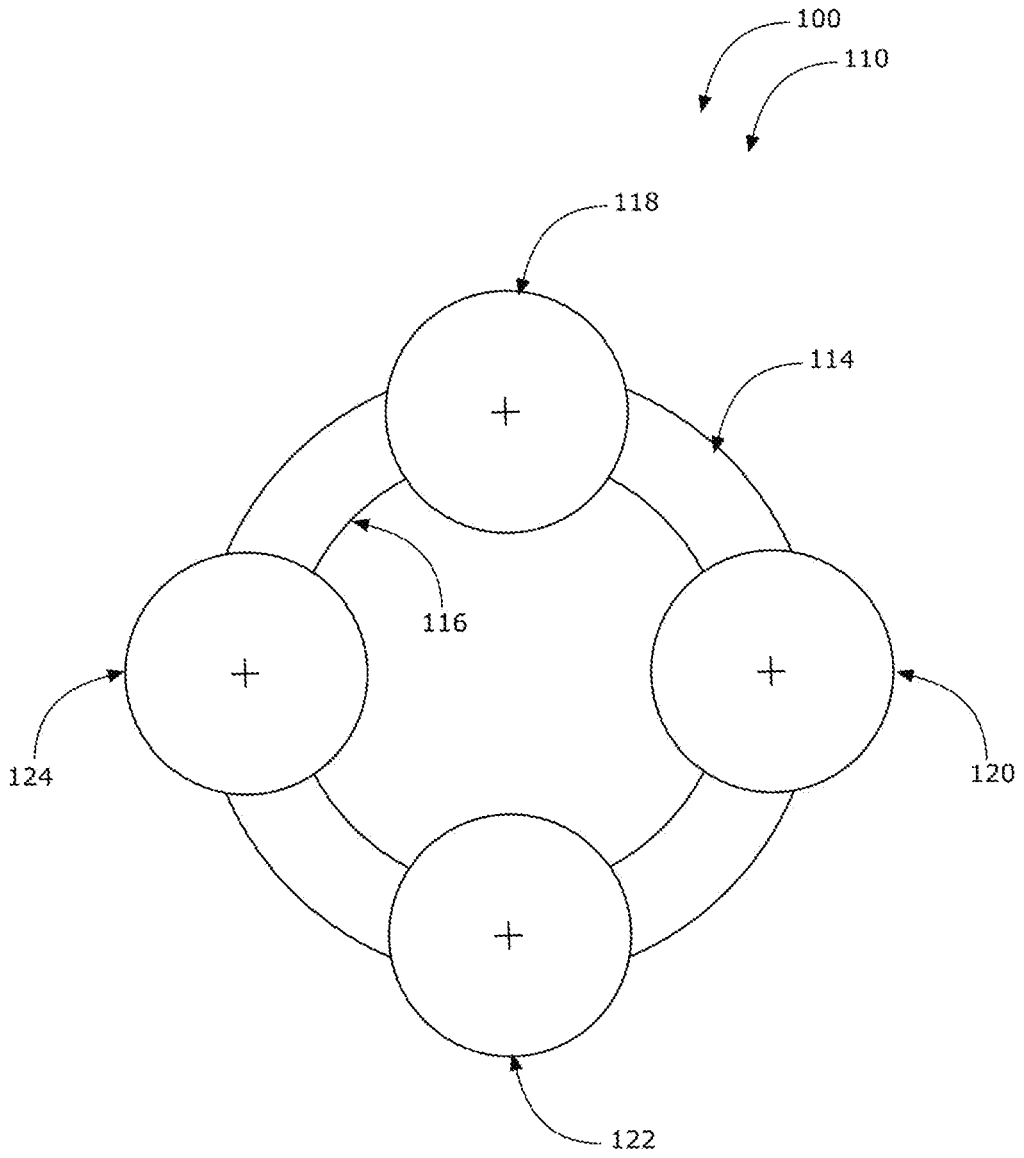
FIG. 3 is a perspective view illustrating the golf tee toss system showing several circles configured into a golf tee toss device according to an embodiment of the present invention of FIGS. 1-2.
Figure 4:
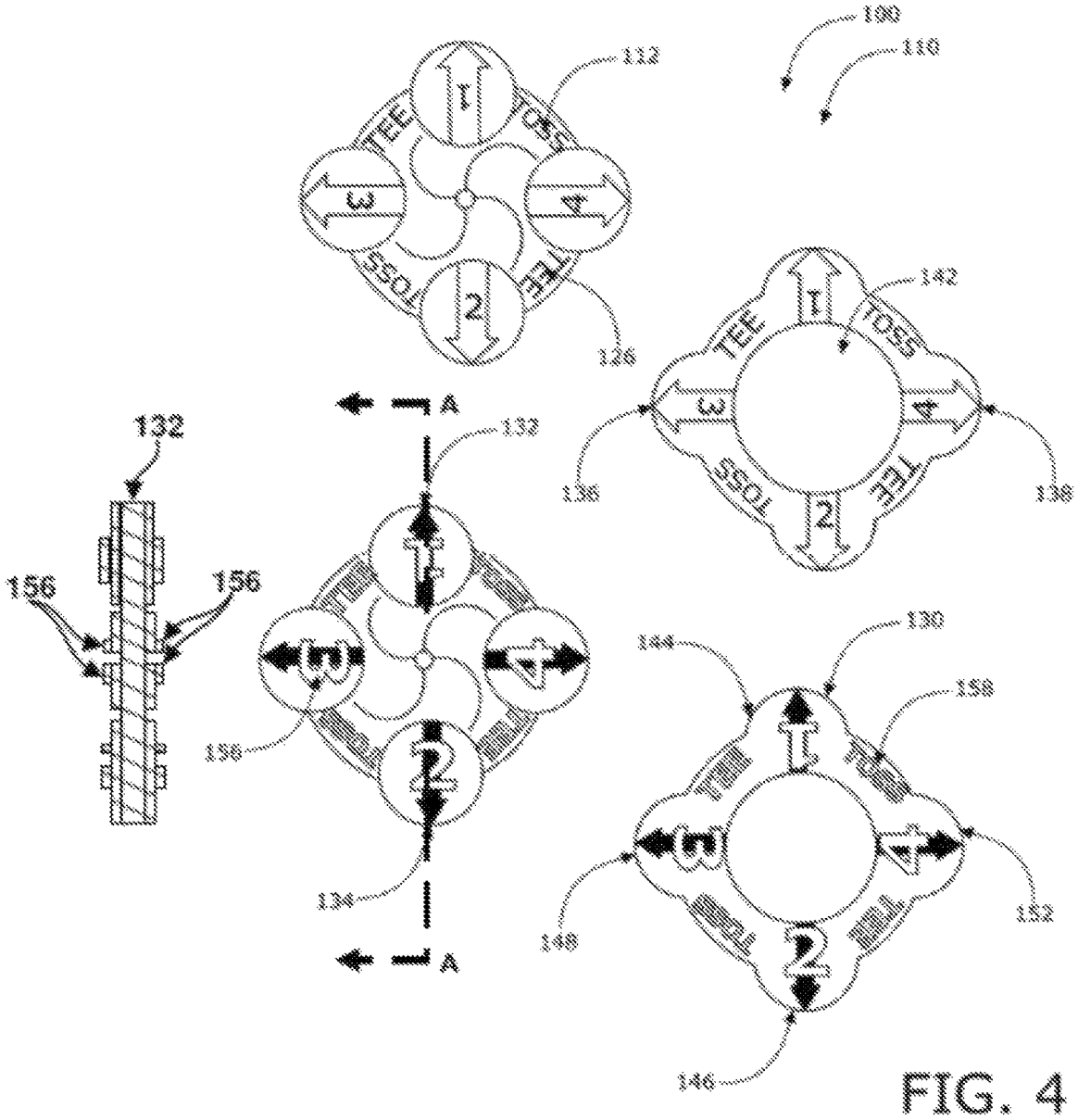
FIG. 4 is a perspective view illustrating the golf tee toss system showing the numerated indicium which indicates the order of play for a golf game once tossed to the ground according to an embodiment of the present invention of FIGS. 1-3.

Referring to the drawings by numerals of reference there is shown in FIG. 1, golf tee toss system 100 comprising: a golf tee toss device 110 having a front surface 112 comprising an outside circle 114, an inside circle 116, a first-small-circle 118, a second-small-circle 120, a third-small-circle 122, a fourth-small-circle 124, and a "Tee" indicium 126, a thickness 128, a periphery 130 comprising a top edge 132, a bottom edge 134, a left edge 136, and a right edge 138, and a back-surface 142 comprising a smooth finish, numerical indicium 156, and a "Toss" indicium 158.

The golf tee toss device 110 is defined by the front surface 112, the thickness 128, the periphery 130, and the back-surface 142 are together structured and arranged for a golfer 140 to determine an order of play of multiple golfers in a golf game when the golfer 140 grips and tosses the golf tee toss device 110 on to ground before a round of golf. The outside circle 114, the inside circle 116, the first-small-circle 118, the second-small-circle 120, the third-small-circle 122, the fourth-small-circle 124, the "Tee" indicium 126 of the front surface 112 and the "Toss" indicium 158 of the back surface 142 are together structured and arranged for the golfer to select the order of play in a golf game.

The thickness 128 is defined by the front surface 112 and the back surface 142 and the thickness 128 is sized such that the golfer can grip the golf tee toss device 110 by grasping the "Tee" indicium 126 of the front surface 112 and the "Toss" indicium 158 of the back surface 142. The periphery 130 is defined by the top quadrant 144, the bottom quadrant 146, the left quadrant 148, and the right quadrant 152. The "Tee" indicium 126 of the front surface 112 and the second numerated gripper indicium 158 of the back surface 142 are each structured and arranged with the smooth finish of the back surface 142 for ease of rotating the golf tee toss device 110 by the golfer 140 when tossed to the ground to select the order of play in a golf game. The "Tee" indicium 126 of the front surface 112 and the "Toss" indicium 158 of the back surface 142 are each structured and arranged with color combinations to determine an order of play of multiple golfers in a golf game when the golfer 140 grips and tosses the golf tee toss device 110 on to ground before a round of golf.

The front surface 112 of the golf tee toss device 110 is structured and arranged with the numerical indicia 156 located on the front surface 112 of each of the first-small-circle 118, the second-small-circle 120, the third-small-circle 122, and the fourth-small-circle 124 for selecting the order of play in a golf game. Each circles represents a selected player and displays their order. The "Tee" indicium 126 comprises a different height of an alpha-letter portion of the "Tee" indicium, and from a height of an arabic-number portion of the "Tee" indicium. The "Toss" indicium 158 comprises a different height of an alpha-letter portion of the "Toss" indicium 158, and from a height of an arabic-number portion of the "Toss" indicium 158. The "Tee" indicium 126 comprises alpha and numeric numerals useful for selecting the order of play in the golf game. The "Tee" indicium 126 may comprise alpha and numeric numerals and each the alpha and numeric numerals further comprise a coined surface.

The first-small-circle 118 protrudes beyond the top edge useful for gripping and tossing the golf tee toss device 110. The second-small-circle 120 protrudes beyond the bottom edge 134 useful for gripping and tossing the golf tee toss device 110. The third-small-circle 122 protrudes beyond the left edge 136 useful for gripping and tossing the golf tee toss device 110. The fourth-small-circle 124 protrudes beyond the right edge useful for gripping and tossing the golf tee toss device 110. The first-small-circle 118 opposes the second-small-circle 120 and the third-small-circle 122 opposes the fourth-small-circle 124.

In certain embodiments, the thickness 128 may be exactly five millimeters. In other embodiments, the thickness 128 comprises more than five millimeters or less than five millimeters. In a preferred embodiment, the golf tee toss device comprises a span of one hundred and twelve millimeters.

Golf tee toss system 100 may be sold as kit 440 comprising the following parts: at least one golf tee toss device; and at least one set of user instructions. The kit has instructions such that functional relationships are detailed in relation to the structure of the invention (such that the invention can be used, maintained, or the like in a preferred manner). Golf tee toss system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

Figure 5:
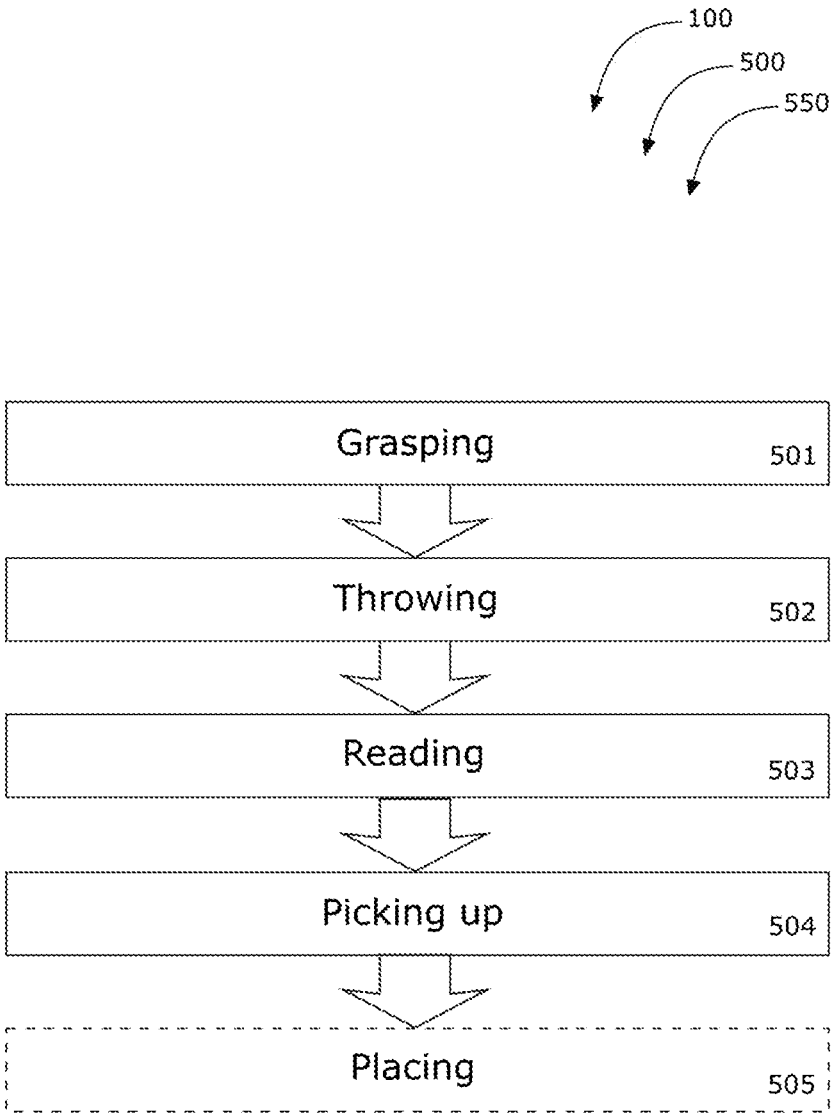
FIG. 5 is a flowchart illustrating a method of use for the golf tee toss system according to an embodiment of the present invention of FIGS. 1-4.

Referring now to FIG. 5 showing flowchart 550 illustrating method of use 500 for golf tee toss system 100 according to an embodiment of the present invention of FIGS. 1-4. As shown, method of use 500 may comprise the steps of: step one 501, grasping a golf tee toss device; step two 502, throwing the golf tee toss device; step three 503, reading multiple-leveled numerated gripper indicium to determine order of play; step four 504, picking up the golf tee toss device from a ground surface; and step five 505, placing the golf tee toss device into a pocket/bag.

It should be noted that step 505 is an optional step and may not be implemented in all cases. Optional steps of method of use 500 are illustrated using dotted lines in FIG. 5 so as to distinguish them from the other steps of method of use 500.

It should be noted that the steps described in the method of use can be carried out in many different orders according to user preference. The use of "step of" should not be interpreted as "step for", in the claims herein and is not intended to invoke the provisions of 35 U.S.C. § 112, ¶6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A throwable device usable for selecting the ordering of golf players teeing off, the throwable device comprising:

a flat card having:

a circular circumference;

a circular bore which is concentric to the circular circumference, such that the circular circumference and the circular bore in combination define a flat ring;

four flat circular indicators having numerical indicia and being evenly arrayed about the flat ring, the four flat circular indicators comprising:

a first circular indicator reading "1", a second circular indicator reading "2", a third circular indicator reading "3", and a fourth circular indicator reading "4";

four alphabetical indicia, each one of the four alphabetical indicia being disposed between two of the four flat circular indicators, such that the four alphabetical indicia are also evenly arrayed about the circumference of the flat circular card;

wherein the four flat circular indicators are not coplanar with the flat card; and wherein the four alphabetical indicia and the numerical indicia are raised lettering;

wherein each of the four flat circular indicators protrude beyond the circular circumference of the flat circular card, thereby forming four lobed edges corresponding to the four flat circular indicators and interrupting the circular circumference; and wherein the four alphabetical indicia comprise:

two first-alphabetic-indicia each reading "Tee" separated from each other by one-hundred and eighty degrees;

two second-alphabetic-indicia each reading "Toss" separated from each other by one-hundred and eighty degrees, each and staggered from the two first-alphabetic-indicia by ninety degrees.

* * * * *